US008671729B2

(12) United States Patent
Verma et al.

(10) Patent No.: US 8,671,729 B2
(45) Date of Patent: Mar. 18, 2014

(54) FLUID-ASSISTED NON-ISOTHERMAL STAMPING OF A SHEET BLANK

(75) Inventors: Ravi Verma, Shelby Township, MI (US); Jon T. Carter, Farmington, MI (US); Paul E. Krajewski, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 363 days.

(21) Appl. No.: 12/828,535

(22) Filed: Jul. 1, 2010

(65) Prior Publication Data

US 2011/0214472 A1 Sep. 8, 2011

Related U.S. Application Data

(60) Provisional application No. 61/309,573, filed on Mar. 2, 2010.

(51) Int. Cl.
*B21D 37/16* (2006.01)

(52) U.S. Cl.
USPC ..... 72/342.2; 72/342.5; 72/342.6; 72/347; 72/361

(58) Field of Classification Search
USPC ..... 72/347–349, 361, 342.2, 342.5, 342.6
See application file for complete search history.

(56) References Cited

U.S. PATENT DOCUMENTS

| | | | | |
|---|---|---|---|---|
| 3,340,714 | A * | 9/1967 | Pohl et al. | 72/342.4 |
| 3,529,458 | A * | 9/1970 | Bowers et al. | 72/60 |
| 4,754,635 | A * | 7/1988 | van den Berg et al. | 72/350 |
| 4,934,167 | A * | 6/1990 | Grims et al. | 72/347 |
| 4,976,131 | A * | 12/1990 | Grims et al. | 72/347 |
| 5,005,396 | A * | 4/1991 | DeSmet | 72/309 |
| 5,306,190 | A * | 4/1994 | Spina et al. | 445/68 |
| 6,619,094 | B2 * | 9/2003 | Juhl | 72/296 |
| 6,694,790 | B2 * | 2/2004 | Ryntz et al. | 72/60 |
| 6,742,374 | B2 * | 6/2004 | Ozawa | 72/342.5 |
| 6,914,225 | B2 * | 7/2005 | Fischer et al. | 219/634 |
| 7,086,268 | B2 * | 8/2006 | Luckey et al. | 72/426 |
| 7,533,553 | B2 * | 5/2009 | Knaup et al. | 72/342.1 |
| 7,644,600 | B1 * | 1/2010 | Michel et al. | 72/69 |
| 8,001,821 | B2 * | 8/2011 | Kondo et al. | 72/342.2 |
| 8,291,740 | B2 * | 10/2012 | Ishimori et al. | 72/342.5 |
| 2002/0152783 | A1 * | 10/2002 | Kleber et al. | 72/60 |
| 2007/0017272 | A1 * | 1/2007 | Kurisu et al. | 72/342.2 |
| 2010/0064759 | A1 * | 3/2010 | Kondo et al. | 72/342.3 |
| 2010/0095733 | A1 * | 4/2010 | Salamon et al. | 72/342.5 |
| 2010/0192659 | A1 * | 8/2010 | Krajewski et al. | 72/349 |

FOREIGN PATENT DOCUMENTS

| | | | |
|---|---|---|---|
| JP | 63072435 | A | 4/1988 |

* cited by examiner

*Primary Examiner* — Bena Miller
(74) *Attorney, Agent, or Firm* — Quinn Law Group, PLLC

(57) ABSTRACT

A method for stamping a desired shape from a sheet blank includes providing the sheet blank. The method also includes locally cooling the sheet blank with a stream of fluid in a predetermined area of high stress concentration to be experienced during forming of the sheet blank into a desired shape. The method additionally includes forming the metal sheet blank into the desired shape in a stamping press with a punch. A system employing the method for forming a sheet blank is also disclosed.

9 Claims, 5 Drawing Sheets

FLUID-ASSISTED NON-ISOTHERMAL STAMPING OF A SHEET BLANK

CROSS REFERENCE TO RELATED APPLICATIONS

This application claims the benefit of U.S. Provisional Application Ser. No. 61/309,573 filed Mar. 2, 2010, the entire contents of which are hereby incorporated by reference.

TECHNICAL FIELD

The present invention relates to fluid-assisted non-isothermal sheet blank stamping.

BACKGROUND

Stamping typically includes a variety of sheet forming manufacturing processes, such as punching using a machine or a stamping press, blanking, embossing, bending, flanging, and coining. The process of stamping is capable of forming either simple or complex shapes at high production rates. Various base materials, such as metals or plastics, may be employed in such a process.

Stamping a sheet blank into a desired shape may occur in a single stage operation, where every stroke of the press produces the desired finished form from the blank, or may be accomplished through a series of stages. Frequently, the final shape produced by the stamping operation, as well as the rate of production, is limited by the ability of the sheet blank to withstand deformation without developing splits and tears.

SUMMARY

A method for stamping a desired shape from a sheet blank includes providing the sheet blank. The method also includes locally cooling the sheet blank with a stream of fluid in a predetermined area of high stress concentration to be experienced during forming of the sheet blank into a desired shape. The method additionally includes forming the metal sheet blank into the desired shape in a stamping press with a punch.

The method may also include transferring the sheet blank to the stamping press, while locally cooling the sheet blank with a stream of fluid may be accomplished during the transfer. Locally cooling the sheet blank with a stream of fluid may also be accomplished in the stamping press prior to or during the forming.

The sheet blank may be characterized by a temperature that is greater than ambient temperature. In such a case, the employed fluid is characterized by ambient temperature, but may also be, for example, a compressed gas characterized by a temperature below ambient. The sheet blank may also be characterized by a temperature that is substantially equivalent to ambient temperature. In such a case, the employed fluid is characterized by a temperature that is below ambient temperature, such as liquid nitrogen.

The stamping press may include a forming die, the forming die may be isothermal, and be at one of an ambient and an elevated temperature. The forming die may also be non-isothermal, and the punch may be characterized by a temperature that is lower than the temperature of the die.

A system for forming a sheet blank, as described above, is also provided.

The above features and advantages and other features and advantages of the present invention are readily apparent from the following detailed description of the best modes for carrying out the invention when taken in connection with the accompanying drawings.

DETAILED DESCRIPTION

Figure 1:
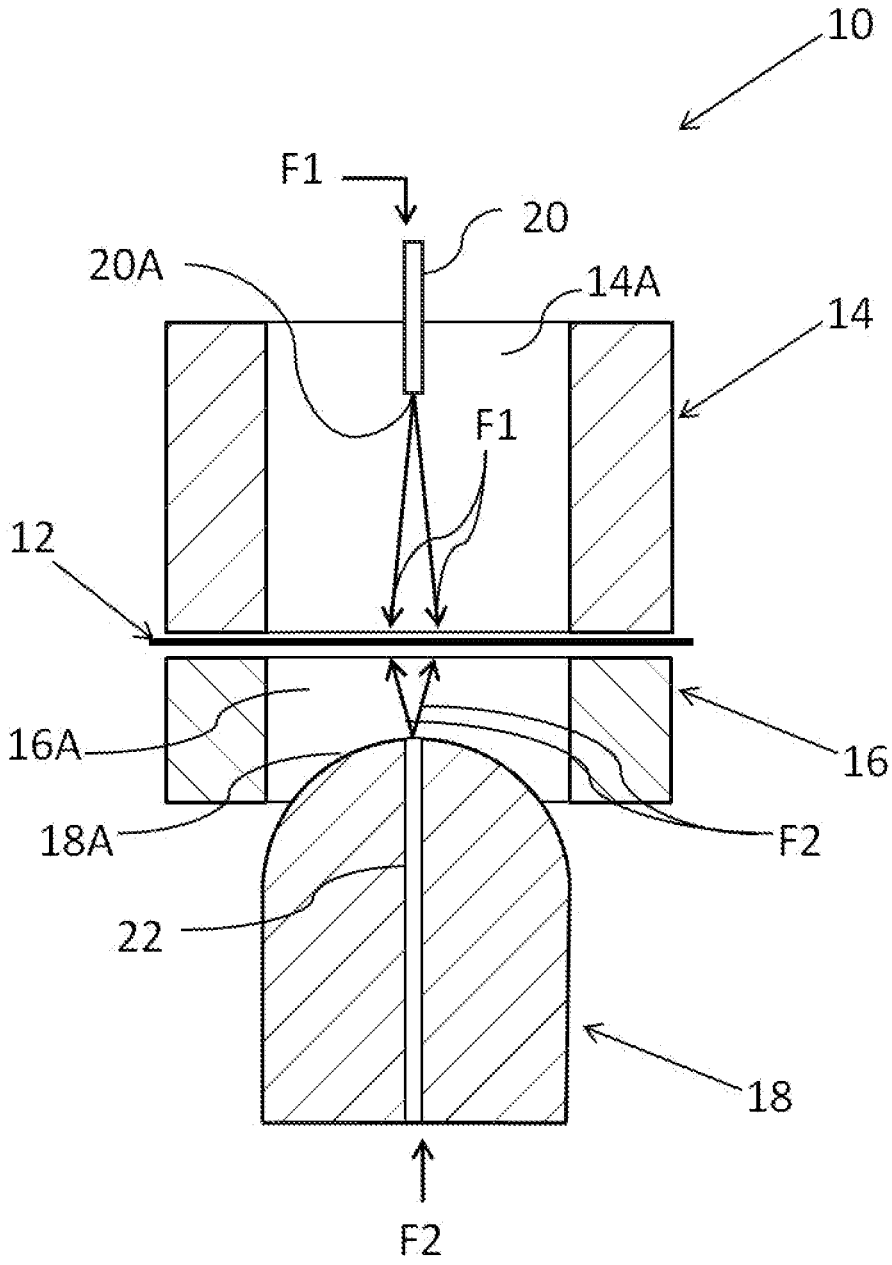
FIG. 1 is a schematic illustration of a cross-section of a stamping press prior to forming, the press including a fluid injection for locally cooling a sheet blank.
Figure 2:
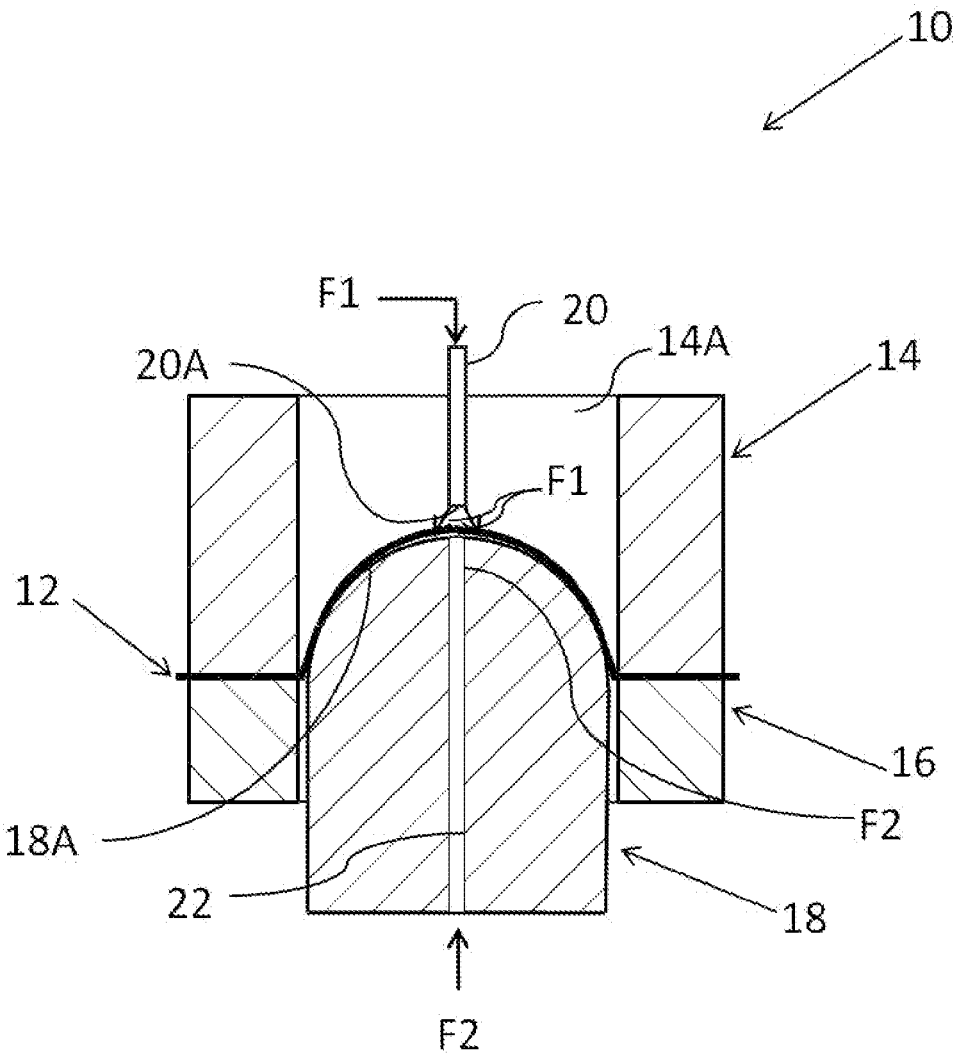
FIG. 2 is a schematic illustration of a cross-section of the stamping press shown in FIG. 1 during forming.

Referring to the drawings in which like elements are identified with identical numerals throughout, FIGS. 1 and 2 illustrate a stamping press 10 arranged for forming a desired shape from a sheet blank 12. Press 10 includes an upper forming die 14, a lower forming die 16, and a punch 18. As known by those skilled in the art, for generating a desired shape from sheet blank 12, the sheet blank is positioned between forming dies 14 and 16, and pressed with punch 18. As envisioned, the employed sheet blank 12 may be from any formable base material, such as metal or plastic. The contemplated forming operation may involve draw-in, pure stretch, or a combination of both, as understood by those skilled in the art.

Upper die 14 and lower die 16 each include a hollowed-out center portion 14A and 16A, respectively. The hollowed-out center portions 14A and 16A may have a substantially round cross-section or any other shape desired for producing a desired shape from the sheet blank 12 during the stamping operation. Similarly, punch 18 is characterized by a cross-section that is complementary to the hollowed-out center portions 14A and 16A. Punch 18 additionally includes a leading portion 18A that is specifically formed to produce the desired domed shape from the sheet blank 12 during the stamping operation.

An injection nozzle 20 is positioned relative to the upper die 14 inside the hollowed-out center portion 14A. Nozzle 20 may be incorporated into the structure of the upper die 14, or be mounted externally on or near the upper die. Nozzle 20 includes an orifice 20A for discharging a stream of fluid F1. Orifice 20A is directed toward the sheet blank 12 at a specific spot or area on the blank that was predetermined to experience high stress concentration during the forming of the blank into the desired shape. The contact of stream of fluid F1 with the predetermined area of high stress concentration on the sheet blank 12 has the effect of locally cooling that particular area, thereby increasing the strength of the base material and decreasing material thinning in the subject area during the forming operation. An injection passage 22 is provided in the structure of the punch 18, to deliver a stream of fluid F2 for cooling the underside of the sheet blank 12 in the same high stress area as cooled by stream of fluid F1. Hence, a stream of fluid may be introduced to sheet blank 12 either from the side of die 14, side of punch 22, or from both directions. A typical target for a material being formed is to be subjected to a magnitude of stress that produces strain within the rate of 0.01 to 10.0 per second, as understood by those skilled in the art. The local cooling of the area of sheet blank 12 having potential high stress concentration is intended to bring the material strain rate down to the above target strain rate.

The temperature of the stream of fluid is purposefully lower than the temperature of the sheet blank 12. For example, the contemplated stream of fluid may be at room ambient or ambient temperature, when the temperature of sheet blank 12 is greater than that of the ambient, in which case regular pressurized air or another type of gas may be used. For example, a stream of air characterized by a pressure around 90 Psi may be employed for cooling of the sheet blank 12. In an alternative embodiment, when the temperature of sheet blank 12 is substantially equivalent to the ambient temperature, the stream of fluid may characterized by a temperature that is below ambient temperature, such as liquid Nitrogen or liquid Helium. In such a case, a stream of liquid Nitrogen around a temperature of negative 196 degrees Celsius, or a stream of liquid Helium around a temperature of negative 296 degrees Celsius may be employed for cooling of the sheet blank 12. For such materials as Aluminum and Magnesium, the nominal temperature of sheet blank 12 may generally be in the range of ambient to 350 degrees Celsius, while the target for temperature in the potential high stress region during localized cooling will be 20 degrees Celsius lower than the nominal temperature of the sheet blank. In general, the contemplated local cooling of the predetermined area of high stress concentration on the sheet blank 12 may be accomplished either prior to the initiation of the forming operation, as shown in FIG. 1, or while the forming is in progress, as shown in FIG. 2.

The injection of the stream of fluid may take place with the upper die 14 kept isothermal throughout the forming operation, wherein the temperature of the die remains generally constant, either at ambient, or at some particular, elevated, i.e., greater than ambient, temperature. Additionally, the injection of the stream of fluid may likewise take place with non-isothermal respective upper and lower dies 14 and 16, wherein the temperature of the die changes along with its surroundings during the forming operation. In the case where non-isothermal respective upper and lower dies 14 and 16 are employed, punch 18 may be purposefully cooled to a temperature that is lower than the temperature of the upper die. The desired cooling of the punch 18 may be accomplished by delivering the stream of fluid F2 through the injection passage 22.

The predetermination of a high stress area on the sheet blank 12 is typically obtained either during modeling of the stamping operation, or during testing and development stage of the stamping operation while the process parameters are fine-tuned and finalized, as understood by those skilled in the art. Although nozzle 20 is shown to include a single orifice, multiple orifices may also be included to direct the stream of fluid to a larger area of high stress concentration, or to separate areas of high stress concentration on the sheet blank 12.

Figure 3:
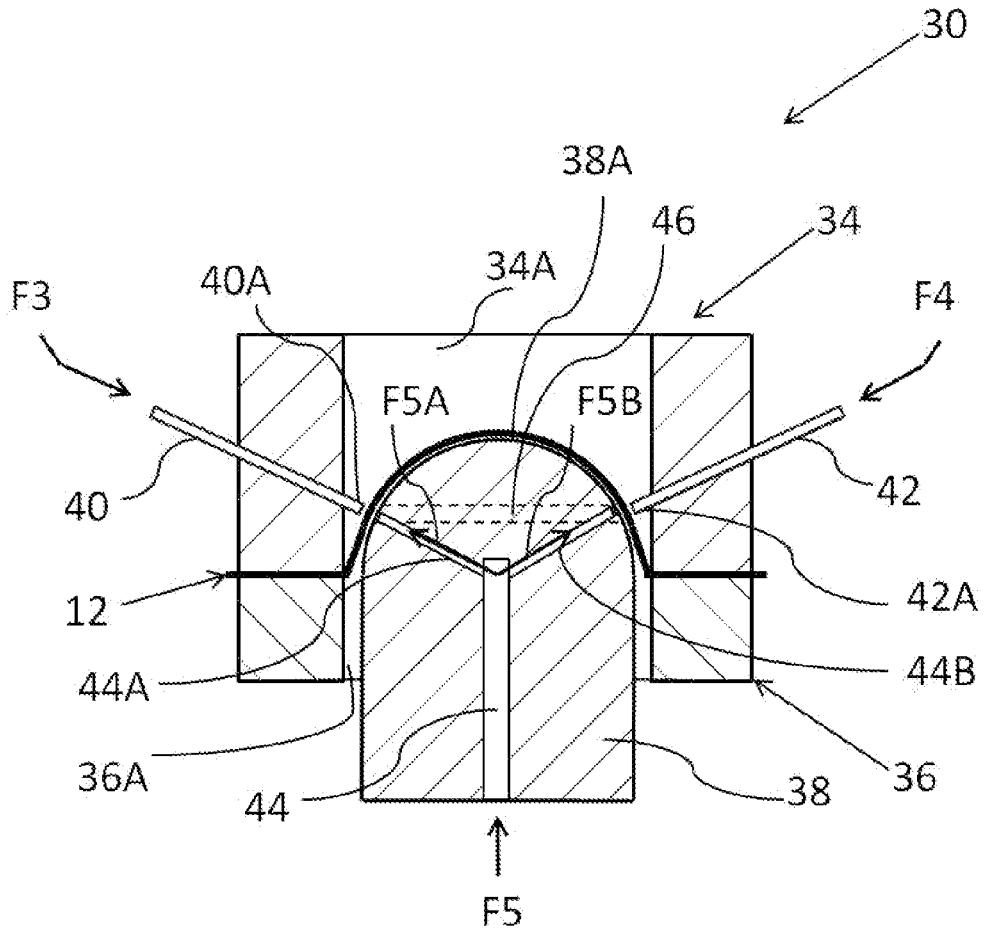
FIG. 3 is a schematic illustration of a cross-section of a stamping press during forming, the press including an alternative embodiment of fluid injection routing for locally cooling a sheet blank.

FIG. 3 depicts a stamping press 30 arranged for forming a desired shape from the sheet blank 12. Similar to the position of press 10 shown in FIG. 2, FIG. 3 shows press 30 while the forming of sheet blank 12 is in progress. Construction of press 30 is similar in most regards to that of press 10 described with respect to FIGS. 1 and 2. Press 30 includes an upper forming die 34, a lower forming die 36, and a punch 38. Upper die 34 and lower die 36 each include a hollowed-out center portion 34A and 36A, respectively. Similar to hollowed-out center portions 14A and 16A, hollowed-out center portions 34A and 36A may have a substantially round cross-section or any other desired shape. Punch 38 is characterized by a cross-section that is complementary to the hollowed-out center portions 34A and 36A, and includes a leading portion 38A that is specifically formed to produce a desired shape from the sheet blank 12.

Still referring to FIG. 3, a plurality of injection nozzles, shown as nozzles 40 and 42, but that may also include any multiple of nozzles, is incorporated into the structure of upper die 34. The plurality of injection nozzles represented by nozzles 40 and 42 may also be mounted externally on or near the upper die 34. As shown, representative nozzles 40 and 42 include respective orifices 40A and 42A for discharging streams of fluid F3 and F4, respectively. Same as in the case of orifice 20A described with respect to FIGS. 1 and 2, orifices 40A and 42A are directed toward the sheet blank 12 at specific spots or areas on the blank that was predetermined to experience high stress concentration during the forming of the blank into the desired shape. The contact of the stream of fluid with the predetermined area of high stress concentration on the sheet blank 12 has the effect of locally cooling that particular area, acts to increase the strength of the base material and to reduce the strain rate seen by the sheet blank in the subject area during the forming operation.

An injection passage 44 is provided in the structure of the punch 38, to deliver a stream of fluid F5 for cooling the underside of the sheet blank 12. Injection passage 44 splits into a plurality of satellite passages, shown as passages 44A and 44B, but may include any multiple of passages. Passages 44A and 44B are provided in the structure of the punch 18 to deliver multiple streams of fluid, represented by streams F5A and F5B, for cooling the underside of the sheet blank 12 in the same high stress area as cooled by streams of fluid F3 and F4. As a result of multiple injection nozzles working in tandem with multiple injection passages, a considerable area of sheet blank 12 that otherwise experiences high stress concentration during forming may be effectively cooled. Passages 44A and 44B may feed an area on the sheet blank 12 directly, or may initially feed a groove 46 disposed around the perimeter of the leading portion 38A, such that the stream of fluid fills the groove prior to contacting the sheet blank.

Figure 4:
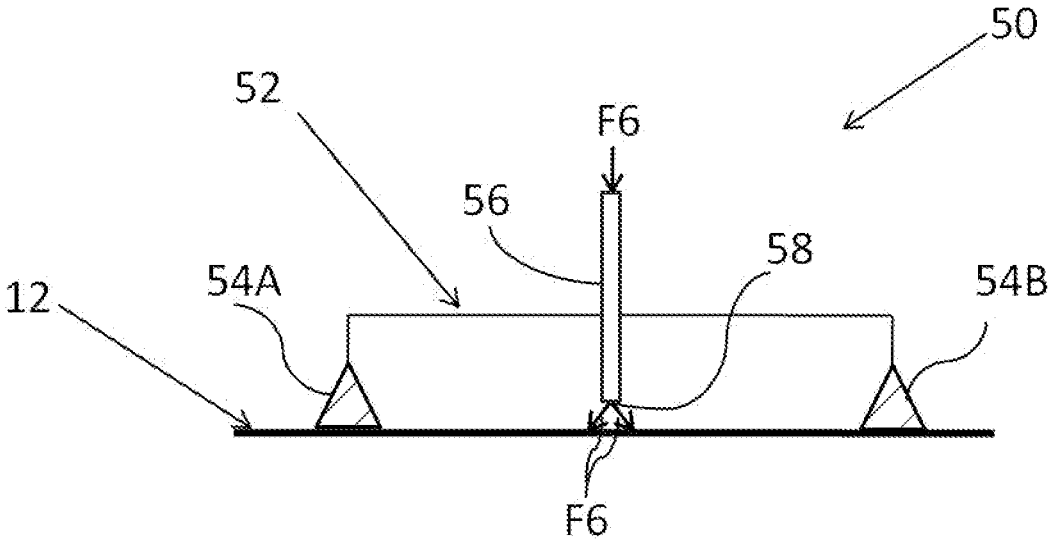
FIG. 4 is a schematic illustration of a cross-section of a transfer apparatus arranged to deliver a sheet blank to a stamping press, including a fluid injection for locally cooling the sheet blank during transfer.

FIG. 4 depicts a transfer apparatus 50, which is preferably a robotic device arranged to transfer sheet blank 12 to either stamping press 10 or stamping press 30. Transfer apparatus 50 includes an "end-effector" or carriage 52 which houses suction cups 54A and 54B. Suction cups 54A and 54B are configured to affix themselves for the duration of the transfer of the sheet blank 12 and for releasing the sheet blank between upper and lower forming dies 14 and 16, or upper and lower forming dies 34 and 36. Transfer apparatus 50 also includes an injection nozzle 56, but may include a plurality of nozzles, as well. Injection nozzle 56 includes an orifice 58 which is configured to discharge a stream of fluid F6.

Similar to the orifices of the injection nozzles employed in stamping presses 10 and 30 as described above, orifice 58 is directed toward the sheet blank 12 at a specific spot or area on the blank that was predetermined to experience high stress concentration during the forming of the blank into the desired shape. The discharge of stream of fluid F6 is affected during the transfer of the sheet blank 12 to either stamping press 10 or stamping press 30. The contact of stream of fluid F6 with the predetermined area of high stress concentration on the sheet blank 12 has the effect of locally pre-cooling that particular area, to thereby increase the strength of the base material and to reduce the strain rate seen by the sheet blank in the subject area during the forming operation.

Figure 5:
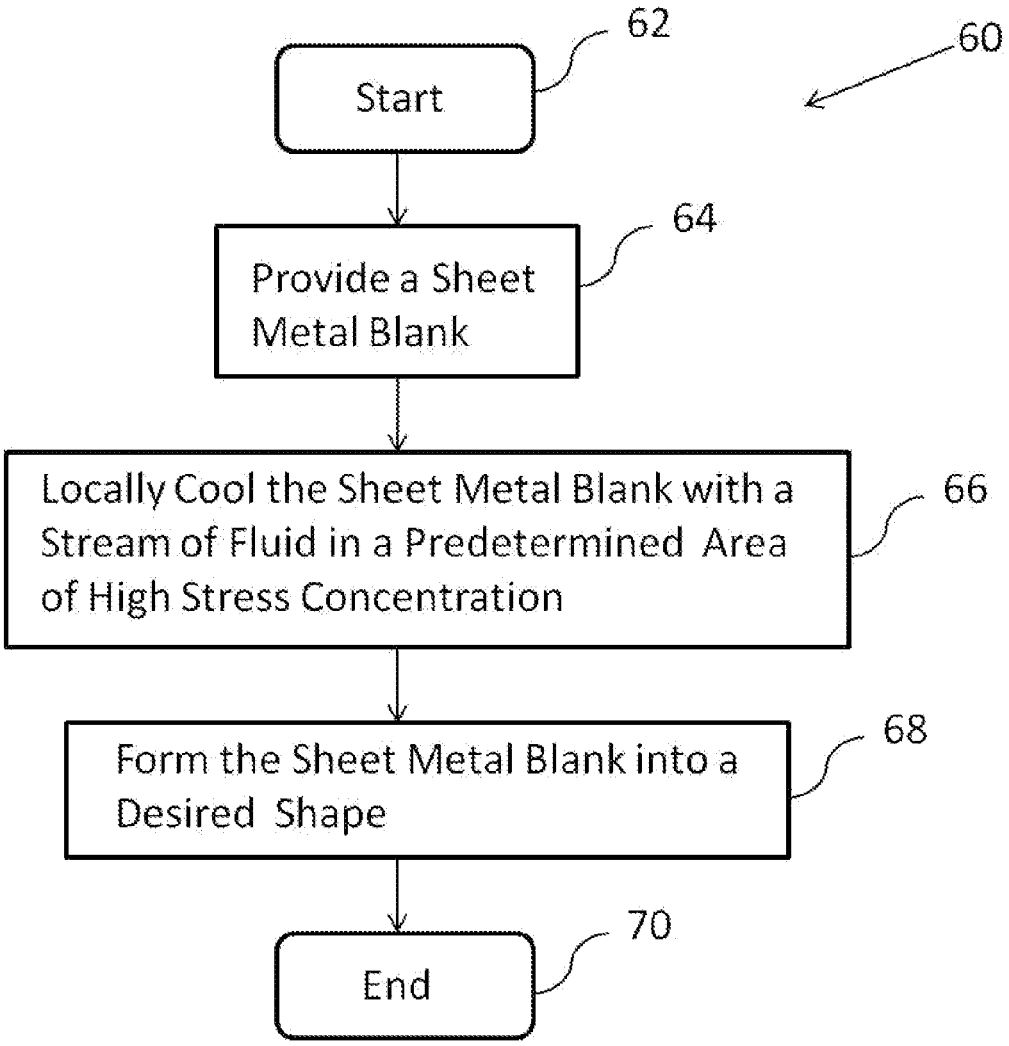
FIG. 5 is a flow chart illustrating a method for stamping of a metal sheet.

FIG. 5 depicts a method 60 for stamping of a metal sheet. Method 60 is herein described with respect to the forming sheet blank 12 in stamping press 10. Method 60 is equally applicable to forming sheet blank 12 in stamping press 30, and to employing the transfer apparatus 50 prior to forming sheet blank 12 in any stamping press. The method commences in frame 62, and proceeds to frame 64, where the sheet blank 12 is provided. Following frame 64, the method advances to frame 66, where the sheet blank 12 is locally cooled with the stream of fluid F1 and/or F2 in a predetermined area of high stress concentration to be experienced during forming of the sheet blank into the desired shape.

According to the method, local cooling of the sheet blank 12 is performed during the forming operation and/or prior to the start of the forming. When performed prior to the start of forming operation, the local cooling may take place at any time prior to the start of forming, e.g. immediately before transfer of the sheet blank to the press 10, during such transfer, and/or in the press just prior to the start of forming. From frame 66, the method proceeds to frame 68, where the metal sheet blank 12 is formed into the desired shape in the stamping press 10 with punch 18. Following the forming of metal sheet blank 12 into the desired shape, the method is completed in frame 70.

While the best modes for carrying out the invention have been described in detail, those familiar with the art to which this invention relates will recognize various alternative designs and embodiments for practicing the invention within the scope of the appended claims.

The invention claimed is:

1. A method for stamping a desired shape from a sheet blank, the method comprising:

locally cooling a sheet blank with a stream of fluid by feeding the stream of fluid directly onto a predetermined area on the sheet blank that experiences high stress concentration during forming of the sheet blank into the desired shape; and forming the metal sheet blank into the desired shape in a stamping press having a punch, including feeding the stream of fluid directly onto the predetermined area during the forming via an injection passage arranged within the punch to thereby increase strength of the sheet blank and reduce a strain rate of the sheet blank in the predetermined area during said forming.

2. The method of claim 1, further comprising transferring the sheet blank to the stamping press in a transfer apparatus having an injection nozzle configured to discharge the stream of fluid, and wherein said locally cooling the sheet blank with the stream of fluid is accomplished during said transferring.

3. The method of claim 1, wherein said locally cooling the sheet blank with a stream of fluid is accomplished in the stamping press prior to said forming.

4. The method of claim 1, wherein said locally cooling the sheet blank with a stream of fluid is accomplished in the stamping press during said forming.

5. The method of claim 1, wherein the sheet blank is characterized by a temperature that is greater than ambient temperature, and the fluid is characterized by ambient temperature.

6. The method of claim 5, wherein the sheet blank is characterized by a temperature that is substantially equivalent to ambient temperature, and the fluid is characterized by a temperature that is below ambient temperature.

7. The method of claim 1, wherein the fluid is liquid nitrogen.

8. The method of claim 1, wherein the stamping press includes a forming die, and the forming die is isothermal at one of an ambient and an elevated temperature.

9. The method of claim 1, wherein the stamping press includes a forming die, the forming die is non-isothermal, and the punch is characterized by a temperature that is lower than the temperature of the die.

* * * * *